United States Patent [19]

Person et al.

[11] 4,019,086

[45] Apr. 19, 1977

[54] ELECTRICAL INDICIA DISPLAY DEVICE AND METHOD FOR MAKING SAME

[75] Inventors: Herman R. Person; Lawrence E. Gilg, both of Columbus, Nebr.

[73] Assignee: Dale Electronics, Inc., Columbus, Nebr.

[22] Filed: Sept. 16, 1975

[21] Appl. No.: 613,815

[52] U.S. Cl. ..... 313/518; 313/210; 313/220; 316/20; 316/24

[51] Int. Cl.[2] ..... H01J 61/00

[58] Field of Search ..... 313/518, 210, 220; 316/20, 24

[56] References Cited

UNITED STATES PATENTS

| | | | |
|---|---|---|---|
| 3,811,060 | 5/1974 | Tsujimoto | 313/518 |
| 3,935,494 | 1/1976 | Dick et al. | 313/220 X |

*Primary Examiner*—Rudolph V. Rolinec
*Assistant Examiner*—Darwin R. Hostetter
*Attorney, Agent, or Firm*—Zarley, McKee, Thomte, Voorhees & Sease

[57] ABSTRACT

The indicia display device of the present invention comprises a sealed compartment having a dielectric substrate therein with anodes and cathode segments imprinted therein. The anodes are imprinted on the dielectric substrate and a layer of dielectric material is imprinted over the anodes. The cathode segments are then imprinted over the layer of dielectric material. An ionizable gas is within the compartment, and produces a cathode glow adjacent the cathode segments whenever an electric potential of a predetermined magnitude is imposed between the cathodes and anodes.

10 Claims, 8 Drawing Figures

ELECTRICAL INDICIA DISPLAY DEVICE AND METHOD FOR MAKING SAME

SUMMARY OF THE INVENTION

The present invention relates to an electrical indicia display device and method for making same. Specifically, the invention relates to a new arrangement of anodes and cathodes in a gas discharge digital display unit.

Conventional gas discharge digital display units generally include a substrate having an upper surface which is enclosed within a sealed envelope having a viewing window on the upper portion thereof. Cathode segments and anodes are placed within the envelope together with an ionizable gas. Whenever an electric potential is imposed between the cathode segments and the anodes, a cathode glow occurs in the ionizable gas adjacent the cathode segments. The cathode segments are usually arranged in patterns which permit them to be activated selectively so as to form glow patterns which correspond to various indicia.

The positioning of the cathodes with respect to the anodes is important in order to obtain the proper glow characteristics. It is important that the glow be isolated to a confined area adjacent each cathode segment. Improper positioning of the cathode segments or the anodes causes cross talk or unwanted blue glow inside the unit. Cross talk is a term describing the phenomenon of glow occurring near a cathode segment which is not actuated, but which is adjacent an actuated cathode segment. Blue glow is a phenomenon whereby a bluish glow occurs over the surface of the anode in such a generalized form as to prevent the clear definition of the indicia desired. Also, the positioning of the anodes with respect to the cathodes is important to determine the starting voltage required to induce glow adjacent each cathode segment. The closer the cathode segment is with respect to the anode, the less voltage is required to intiate cathode glow. Variations in the distances of the various cathode segments with respect to the anodes results in variation in the starting voltage required to initiate each of the respective cathode segments.

Presently the arrangement of the cathodes to the anodes is done in one of two ways. One commonly used method is to place the cathode segments on a substrate within the sealed envelope. The anodes are then mounted on the under surface of the glass window in spaced relation above the cathode segments. The anodes are translucent so that whenever a glow occurs adjacent a cathode segment, that glow is visible from outside the window.

Several disadvantages are encountered with the above arrangement. Even though the anode is translucent, it causes reflections from outside the window, and therefore makes it more difficult for the viewer to see the indicia being displayed. Furthermore, the manufacturer of such units requires two technologies for placing the cathodes and the anodes in the unit. One technology is utilized for placing the translucent anode on the under surface of the glass window, and another technology is used for placing the cathode segments on the upper surface of the substrate within the compartment.

Other arrangements of anodes and cathodes within the envelope have been utilized. For example, the anodes and cathodes have been placed in side by side relationship on the upper surface of the substrate. This arrangement also has disadvantages. With this side by side arrangement, it is difficult to space the cathode segments equidistantly from all the anodes. Accordingly, there is often variation in the starting voltage required for each of the separate cathode segments. Also, the distance between the anodes and the cathodes must be relatively large, and this results in requiring a higher starting voltage than with the units having the anode on the under surface of the window. Also, cross talk and unwanted blue glow often occur in these side by side units.

The present invention contemplates placing both the anodes and the cathodes on the substrate. However, the cathodes are placed over the anode and separated therefrom by a layer of dielectric material. This technology permits a series of printed layers to be formed on the substrate, forming first the anodes, second, the dielectric layer, and third, the cathode segments. The same technology is utilized for both the imprinting of the anodes and the imprinting of the cathodes. The distance between the anodes and the cathodes is determined by the thickness of the dielectric layer therebetween. Thus it is possible to make this distance small so as to minimize the starting voltage required to induce cathode glow. Furthermore, because this distance is consistent from one cathode segment to another, there is greater consistency in the starting voltage required to actuate the various cathode segments.

It has also been determined that the spacing of the window above the substrate affects the performance of the cathode segments. In the configuration with a transparent anode on the front glass cover, it has been known that the spacing between the glass cover and the substrate is important, and this spacing has been maintained at a distance of from 0.020 to 0.015 inches. However, when the anodes and cathodes have been placed on the same substrate, little importance has been attached to the distance between the glass cover and the substrate.

This distance is important to the present invention, for it has been found that as the spacing between the glass cover and the substrate increases, the starting voltage goes down, the cross talk problem increases, and the tendency for blue glow to form between adjacent digits increases. As the spacing decreases, the starting voltage goes up, the cross talk problem diminishes and the tendency for blue glow to form between digits decreases while the tendency for blue glow to form between anodes and cathodes of the same digit increases. The present invention conteplates a distance of 0.035 inches to 0.045 inches to produce the best results.

Therefore, a primary object of the present invention is the provision of an electrical indicia display device and method for making same.

A further object of the present invention is the provision of a method and means which produces greater consistency in starting voltage required to induce cathode glow adjacent each of the various cathode segments.

A further object of the present invention is the provision of a method and means which results in a low starting voltage which is comparable in magnitude to the starting voltage required for devices having a transparent anode on the front glass cover.

A further object of the present invention is the provision of a method and means which results in a greater electrical field being produced between the anode and cathode segments than has been obtained in previous side by side cathode-anode arrangements.

A further object of the present invention is the provision of a method and means which permits easier control of the distance between the anode and the cathode.

A further object of the present invention is the provision of a method and means which permits the use of identical technology for placing both the anodes and the cathodes in the unit.

A further object of the present invention is the provision of a method and means which chooses the spacing between the glass cover and the substrate so as to provide the most advantageous combination of factors relating to starting voltage, cross talk, and a blue glow.

A further object of the present invention is the provision of a method and means which is economical and simpler than previous electrical indicia display devices and methods for making same.

BRIEF DESCRIPTION OF THE FIGURES OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION

Figure 1:
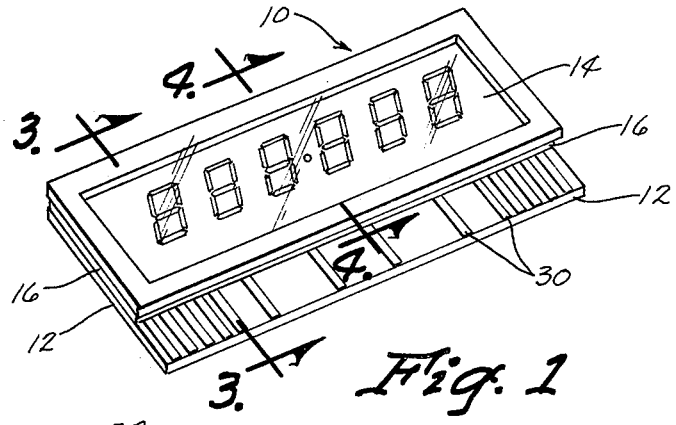
FIG. 1 is a perspective view of the present invention.

Referring to the drawings, the numeral 10 refers to the indicia display device of the present invention. Device 10 comprises a housing formed by a substrate 12 and a glass window 14 which are joined in spaced parallel relationship by a glass solder material 16 so as to form a sealed compartment 18 therebetween. Substrate 12 includes an aperture 20 therein which provides communication into the interior of compartment 18. A glass tube 22 is secured over aperture 20 by means of glass solder 23. Glass tube 22 has been melted to close off its end 24 and thereby hermetically seal compartment 18 from the atmosphere.

The first steps in the fabrication of device 10 involve screen printing. Various dielectric materials may be utilized for the substrate including aluminum oxide or glass or other materials.

Figure 2A:
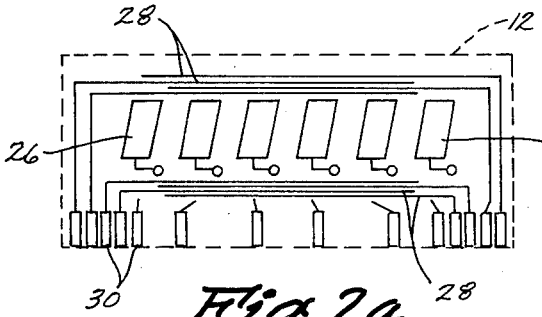
FIGS. 2A, 2B, 2C, and 2D are plan views showing the substrate having the first, second, third, and fourth printing thereon respectively.

The first pattern is a conductor layer which is printed on the substrate as shown in FIG. 2A. The layer includes a plurality of anodes 26 which may have varying shapes, but which are shown in FIG. 2A to be shaped in parallelograms (for numerals) and small circles (for decimal points). This first conductor pattern also includes a plurality of elongated conductors 28 which are in electrical connection with a plurality of leads 30 positioned adjacent the edge of substrate 12.

The conductor material is an ink manufactured by DuPont Company under the product designation No. 8730 PD-AG. The ink is then electroplated with nickel. Alternatively, there are low firing nickel pastes commercially available which could be used.

Figure 2B:
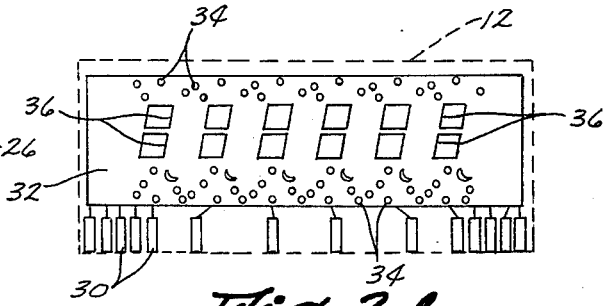

FIG. 2B illustrates the second pattern which is printed on the substrates. This pattern is a dielectric layer 32 which is preferably printed twice to insure good insulation characteristics. The pattern includes a rectangular sheet having a predetermined pattern of vias or holes 34 therein. Also, the dielectric layer 32 has a plurality of anode openings 36 therein positioned in registered alignment over anodes 26.

Figure 3:
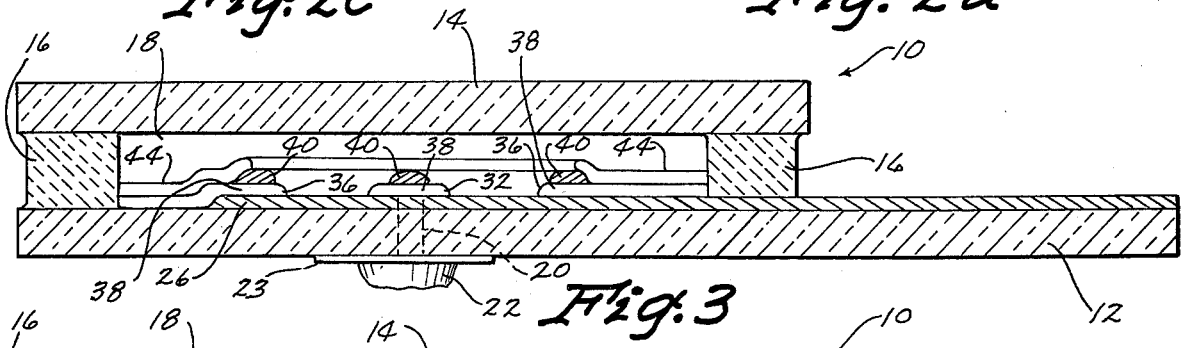
FIGS. 3 and 4 are sectional views taken along lines 3—3 and 4—4 of FIG. 1.
Figure 4:
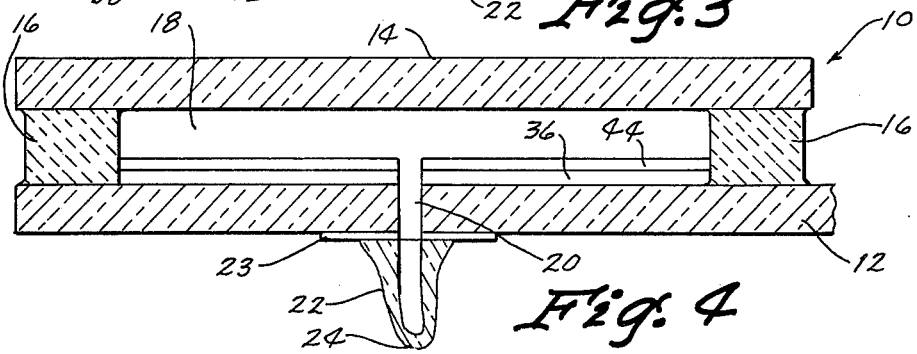
Figure 5:
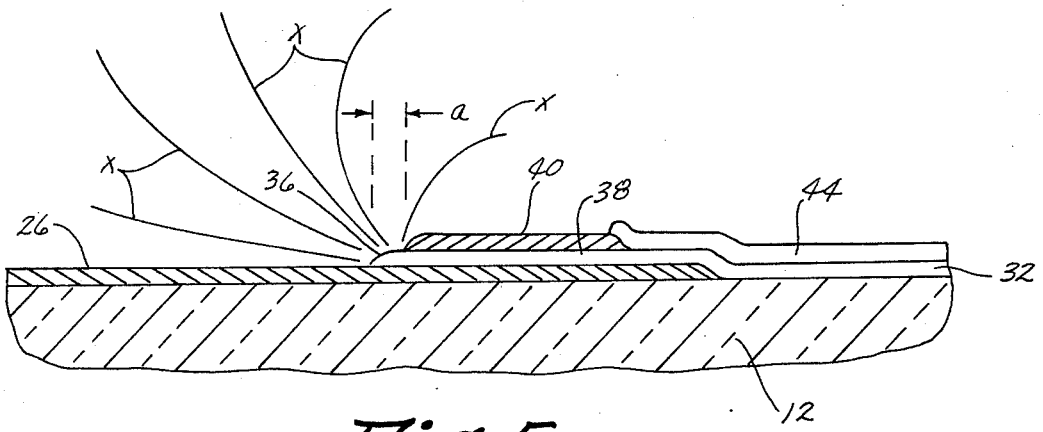
FIG. 5 is a view similar to FIG. 3, showing an enlarged view of the cathode segment, dielectric layer, and anode, and illustrating the lines of force which result from imposing a potential difference on the anode and cathode.

The location of vias 34 is arranged so as to be in registered alignment with various conductors 28 shown in FIG. 2A. The relationship of anode openings 36 to anodes 26 is shown in FIGS. 3–5. The margins of anode openings 36 overlap slightly around the edges of anodes 26, and these overlapping portions are designated by the numeral 38.

Figure 2C:
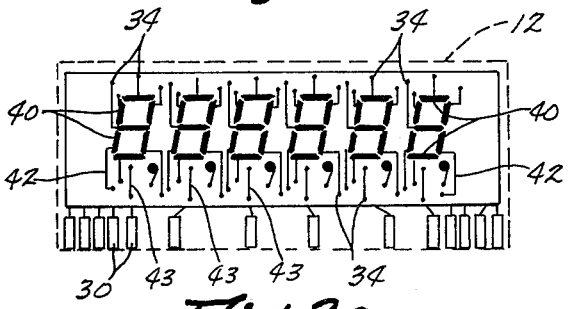

The third printing step is shown in FIG. 2C and comprises printing a conductor ink in the form of cathode segments 40. Also connected to each cathode segment 40 is a conductor 42 which leads to a via 34 where it is in electrical contact through via 34 to conductors 28 of the first printing shown in FIG. 2A. A plurality of anode conductors 43 are each connected at one end through a via 34 to an anode 26 and at the opposite end through a via 34 to a lead 30. Segments 40 are arranged in FIG. 8 pattern in a conventional manner presently known in the art. By inducing cathode glow adjacent various combinations of the segments 40 within each FIG. 8 pattern, it is possible to produce various digits which are visible through window 14. Each segment 40 of each digit is connected through a via to the conductor pattern below shown in FIG. 2A.

Figure 2D:
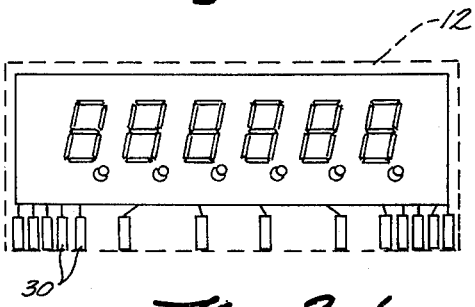

The last pattern is another dielectric layer 44 shown in FIG. 2D. This layer covers all portions of the segments which are not supposed to show. It also provides contrasting background so the display will be easier to read.

After each of the above prints has been made, the unit is fired in a belt kiln at the appropriate temperature and time for the various materials used. This fires each layer of paste into a permanent rigid conductor or insulator. The resulting component is an electrical circuit.

Of particular importance is the arrangement of cathode segments 40 with respect to anode 26 and dielectric layers 36. Cathode segments 40 overlie the overlapping portions 38 of dielectric layer 32 so that the overlapping portions 38 separate cathode segments 40 from anode 26. The inner margins of anode openings 36 in dielectric layer 32 are exposed to the atmosphere within compartment 18.

FIG. 5 illustrates the electrical field which is produced whenever a potential difference is imposed between cathode segments 40 and anode 26. The letters X designate the lines of equal potential which emanate adjacent the exposed inner margins of anode openings 36 in FIG. 5. It can be seen that the distance between cathode segments 40 and anode 26 is determined by the thickness of dielectric layer 32. The electric field intensity is dependent upon the thickness of the dielectric and is not greatly affected by the distance designated *a* in FIG. 5. Thus it is possible for a small manufacturing error to occur in the placement of cathode segments 40 with respect to the edges of anode opening 36. Slight variations will not result in appreciable differences in the intensity of the electric field designated by lines X. Because the field intensity is great, it is possible to induce cathode glow with a smaller starting voltage in the present invention than in previous devices which placed cathodes and anodes on the substrate in side by side relationship.

After the final printing shown in FIG. 2D has occurred, glass window 14 is sealed over substrate 12 by means of glass solder 16. Conventional glass solders manufactured on the market have been found to be satisfactory for this purpose.

After assembly the display unit is attached to a high vacuum pump by means of glass tube 22 (which at this point in the assembly has not yet been sealed off). Compartment 18 is then exhausted and the display unit is based at 300° C. to 400° C. The pressure within compartment 18 is held below $10^{-7}$ torr.

After baking the display is then ready to be filled. The proper mixture of neon plus another gas (usually argon) is introduced together with mercury and the exhaust tube is cut off with a torch, sealing the proper atmosphere inside the display. The display is then heated to the proper temperature to vaporize the mercury inside. This temperature depends upon the pressure sealed inside the display. After the mercury is vaporized the remainder of the exhaust tube is cut off as near to the substrate as possible, making a short stub which is closed at tube end 24.

Several advantages are obtained by the present invention. A greater consistency is obtained in the starting voltage from one cathode segment to another. The starting voltage is kept low due to the small distance between the cathodes and the anodes, and therefore, it is possible to maintain starting voltages as least as low as is obtained in units having the anode placed on the under surface of the glass window. The present arrangement creates a greater electrical field between the cathodes and the anodes in response to a given potential difference than is obtained with the side by side arrangement previously known. Furthermore, it is easier to control the thickness of the dielectric layer in the present invention than the lateral distance of the anodes to the cathodes in the previous side by side arrangements. Since the intensity of the electric field depends upon the distances of the cathodes from the anodes, greater consistency is obtained by the present invention and also a smaller starting voltage is required to produce a given electric field.

The present method also utilizes the same technology for both anodes and cathodes, and therefore, simplifies the manufacturing process. Furthermore, the present invention eliminates the necessity for using a transparent or translucent anode on the under surface of the viewing window. Thus the present invention produces a device which permits easier viewing of the cathode glow from outside the unit and minimizes the reflection which occurs from the viewing window.

Another important aspect of the present invention is the spacing between the glass cover and the substrate. In the usual prior art configuration with the transparent anode on the front glass cover, the spacing is approximately 0.020 inches to 0.015 inches, and must be held there to maintain the correct starting voltage. Where the anodes and cathodes are on the same substrate, the spacing between the glass cover and the substrate has not been recognized as being important. However, this distance is important in the present invention. As the spacing increases, the starting voltage goes down, the cross talk problem increases, and the tendency for blue glow to form between adjacent digits increases. As the spacing decreases, the starting voltage goes up, the cross talk problem diminishes and the tendency for blue glow to form between digits decreases while the tendency for blue glow to form between anodes and cathodes of the same digit increases. It has been founded that a distance of 0.035 inches to 0.045 inches produces the best results.

In view of the foregoing, it can be seen that the device accomplishes at least all of its stated objectives.

What is claimed is:

1. A method for making an indicia display device comprising:

printing a plurality of electrical conductors and at least one anode on the upper surface of a dielectric substrate, printing a first dielectric layer over said conductors and anode, said first dielectric layer having an anode opening therein;

positioning said first dielectric layer during printing thereof so that said anode opening exposes a first portion of said anode, and the marginal edges of said anode opening overlie a second portion of said anode, printing a plurality of cathode segments over said first dielectric layer adjacent said marginal edges of said anode opening so that said cathode segments are overlying said second portion of said anode and said dielectric material separates and insulates said cathode segments from said anode;

printing a second dielectric layer over said cathode segments, said second dielectric layer having an indicia opening registered with said cathodes and exposing said cathodes adjacent said marginal edges of said anode opening in said first dielectric layer;

sealing said upper surface of said substrate in a compartment having a viewing window therein;

introducing an ionizable gas capable of cathode glow into said compartment and into communication with said exposed portions of said cathode segments.

2. A method according to claim 1 comprising positioning said window a distance of from 0.035 inches to 0.045 inches from said substrate.

3. An indicia display device comprising:

a housing having a sealed compartment formed therein and a window for viewing into said compartment;

a dielectric substrate having an upper surface presented inwardly towards said compartment;

at least one anode supported on said upper surface of said substrate;

at least one cathode segment having at least one edge thereof overlying said anode;

a first layer of dielectric material interposed between said anode and said cathode segment to electrically insulate said anode and said cathode segment from each other, said first layer of dielectric material having an opening therein with one margin of said opening being located adjacent said one edge of said cathode segment;

an ionizable gas within said compartment and in communication with said one margin of said opening in said first dielectric layer;

conductor means electrically connected to said anode and said cathode segment for connection to a voltage source to impose a potential difference of predetermined magnitude between said anode and said cathode segment whereby said gas will become ionized adjacent said one margin of said first dielectric layer.

4. An indicia display device according to claim 3 wherein said anode is imprinted on said substrate and said cathode segment is imprinted on said first dielectric layer.

5. An indicia display device according to claim 4 wherein a plurality of cathode segments overlie said anode, said first layer of dielectric material being interposed between all of said cathode segments and said anode and having a plurality of exposed margins each of which is located adjacent one of said cathode segments and each of which is exposed to said gas.

6. An indicia display device according to claim 5 wherein a second layer of dielectric insulative material overlies portions of said cathode segments, said second layer having an opening therein which exposes said margins of said openings in said first layer and portions of said segments to said gas.

7. An indicia display device according to claim 3 wherein said window is spaced a distance of from 0.035 inches to 0.045 inches from said substrate.

8. An indicia display device comprising:

a housing having a sealed compartment formed therein and a window for viewing into said compartment;

a dielectric substrate having an upper surface presented inwardly towards said compartment;

at least one anode supported on said upper surface of said substrate, said anode having a plurality of perimeter edges;

a plurality of cathode segments superimposed in a predetermined pattern over said anode;

a first layer of dielectric material interposed between said anode and cathode segments to electrically insulate the anode and cathode segments from each other, said first layer having openings therein which form marginal dielectric edges, said marginal edges each being located adjacent one of said cathode segments;

an ionizable gas within said compartment and in communication with said marginal edges of said first layer of dielectric material;

conductor means electrically connected to said anode and said cathode segments for connections to a voltage source to impose a potential difference of predetermined magnitude between said anode and selected ones of said cathode segments whereby said gas will become ionized adjacent said selected cathode segments.

9. An indicia display device according to claim 8 wherein said conductor means comprise a first group of conductors imprinted on said substrate and a second group of conductors imprinted on said first dielectric layer, said first layer of dielectric material having a predetermined pattern of vias therein for permitting electrical contact between said first and second groups of conductors at preselected points.

10. An indicia display device according to claim 9 wherein a plurality of electrical leads are connected to said first group of conductors and extend outwardly from said compartment.

* * * * *